United States Patent [19]

Kubo et al.

[11] Patent Number: 5,068,141

[45] Date of Patent: Nov. 26, 1991

[54] POLYOLEFIN-TYPE NONWOVEN FABRIC AND METHOD OF PRODUCING THE SAME

[75] Inventors: Eiichi Kubo; Yoshihiro Kammuri; Koichi Nagaoka; Takeshi Kitahara; Yoshiki Miyahara, all of Uji; Syunichi Kiriyama, Gose; Yasunobu Mishima, Uji, all of Japan

[73] Assignee: Unitika Ltd., Hyogo, Japan

[21] Appl. No.: 408,184

[22] Filed: Sep. 15, 1989

Related U.S. Application Data

[62] Division of Ser. No. 56,544, Jun. 1, 1987, abandoned.

[30] Foreign Application Priority Data

| | | | |
|---|---|---|---|
| May 31, 1986 | [JP] | Japan | 61-126745 |
| Feb. 3, 1987 | [JP] | Japan | 62-24332 |
| Feb. 6, 1987 | [JP] | Japan | 62-26977 |

[51] Int. Cl.[5] ..... D02G 3/00; D04H 1/04

[52] U.S. Cl. ..... 428/219; 428/296; 428/364; 428/397; 428/398; 428/401

[58] Field of Search ..... 428/224, 225, 219, 288, 428/296, 397, 398, 401, 364

[56] References Cited

U.S. PATENT DOCUMENTS 4,803,907 5/1989 Sawyer et al. ..... 428/225

FOREIGN PATENT DOCUMENTS 0154197 9/1985 European Pat. Off. ..... 428/364

*Primary Examiner*—Lorraine T. Kendell

*Attorney, Agent, or Firm*—Joseph W. Farley

[57] ABSTRACT

A nonwoven fabric formed of highly spinnable heat bonded continuous filaments which is strong and soft and is superior in hand. The nonwoven fabric is formed by heat-bonding filaments of linear low density polyethylene so that the number of defects is not more than 0.01/kg, the weight is 10–100 g/m$^2$, the percentage bond area is 7–20% and the total hand value is 4–300 g. The nonwoven fabric is produced by melt-extruding the above-mentioned linear low density polyethylene to form filaments which are drawn by air guns at a high speed so that they are deposited on a moving collection belt to form a web which is then heat treated at a temperature 15°–30° C. lower than the melting point of the filaments. The nonwoven fabric an be formed of filaments of hollow or flat cross section. It is also possible to utilize bicomponent filaments having a sheath component made of linear low density polyethylene and a core component made of polyethylene terephthalate.

5 Claims, No Drawings

POLYOLEFIN-TYPE NONWOVEN FABRIC AND METHOD OF PRODUCING THE SAME

This is a divisional of copending application Ser. No. 07/056,544 filed June 1, 1987, and now abandoned.

FIELD OF THE INVENTION

The present invention relates to a polyolefin-type nonwoven fabric and a method of producing the same.

BACKGROUND OF THE INVENTION

Heretofore, low density polyethylene (LDPE) and high density polyethylene (HDPE) have been used to obtain polyethylene filaments. In recent years, however, linear low density polyethylene (hereinafter referred to as LLDPE) obtained by copolymerization of ethylene and octene-1, as disclosed in Japanese Patent Application Laid-Open No. 209010/1985 and U.S. Pat. No. 4,644,045, has come to be used for the production of polyethylene filaments.

In recent years, there has been a strong tendency toward increasing spinning speed in order to obtain nonwoven fabrics on a spunbound basis or to reduce production cost by simplifying the process for obtaining multifilaments. However, the LLDPE in said Japanese Patent Application Laid Open No. 209010/85 in which density and melt index (hereinafter referred to as MI value) are maintained in fixed ranges, is still unsatisfactory in spinnability required for high speed spinning. That is, in the so-called spunbond method wherein continuous filaments are drawn by suction of air (hereinafter referred to as air gun) and then directly formed into a nonwoven fabric on a deposition surface, said LLDPE can hardly be formed into fine denier filaments, for some reason which has not been adequately explained. Another drawback is that to obtain fine denier filaments it is necessary to increase air pressure in the air gun.

Thus, in recent years, U.S. Pat. No. 4,644,045 has been disclosed as a method for producing nonwoven fabrics on a spunbond basis. This relates to a method of producing soft spunbonded nonwoven fabrics by using linear low density polyolefin polymer in which percent crystallinity, cone die melt flow value, and the ratio of the natural logarithm of die swell to melt index are specified, said linear low density polyolefin polymer being melt spun at melt extrusion temperatures of 185°-215° C., the object being to obtain soft spunbonded nonwoven fabrics. Said method, however, has a problem that since the melt extrusion temperature is low, the drawing tension exerted during spinning is high, so that if the spinning speed is increased, frequent yarn breaks take place and the number of defects in nonwoven fabrics increase; thus, nonwoven fabrics of low quality can only be obtained.

Methods of bonding filaments together in the production of nonwoven fabrics include one which is based on entanglement of filaments as in the needle punch method or one which is based on the use of various adhesive agents as binders. In such nonwoven fabrics as used in disposable diapers or covering paper sheets for sanitary absorbers, such properties as soft touch, lightweight, and high tensile strength are required. In order to meet these required qualities as much as possible, a production system which is based mainly on the binder method has been employed. The binder method applies an adhesive solution to a web; however, there are problems that energy is required to remove the solvent for the adhesive solution and that working environments are not good. To overcome these problems, it has become common practice to use a method in which filaments which are lower in melting point than webconstituting filaments are mixed into a web and then, after such web being formed, these filaments are bonded together through heat treatment. Bicomponent filaments using fiber forming polymers of different melting points as components have come to be used. This is known in Japanese Patent Publication No. 10583/1986 and 38214/1979.

The low melting point component in bicomponent heat bonded filaments for nonwoven fabrics such as covering paper sheets for disposable diapers and sanitary absorbers is usually polyethylene, particularly medium density or high density polyethylene or LLDPE. A nonwoven fabric obtained by using bicomponent heat bonded filaments having medium density or high density polyethylene as the low melting point component, has a drawback that it is stiff to the touch. Another nonwoven fabric using bicomponent heat bonded filaments in which commercially available LLDPE obtained by copolymerization of $\alpha$-olefin having 4–8 carbon atoms is used as the low melting point component provides soft touch; however, it has a problem that since it hardly allows high spinning speed, a nonwoven fabric on the basis of spunbond method can hardly be obtained.

An object of the present invention is to provide a nonwoven fabric of satisfactory performance formed of highly spinnable heat bonded continuous filaments.

More particularly, the invention provides a nonwoven fabric and a method of producing the same, wherein said nonwoven fabric comprises filaments formed of linear low density copolymer of ethylene and octene-1, which is linear low density polyethylene, containing substantially 1–10 weight percent octene-1 and having a density of 0.900–0.940 g/cm$^3$, a melt index value of 5–45 g/10 minutes as measured by the D-1238(E) of ASTM, and a heat of fusion of not less than 25 cal/g as measured by DSC, said filaments being heat bonded together so that the number of defects is not more than 0.01/kg of the fabric, the weight is 10–100 g/m$^2$, the percentage bond area is 7–20% and the total hand value is 4–300 g.

The invention also provides a nonwoven fabric and a method of producing the same, wherein said nonwoven fabric comprises bicomponent filaments having a sheath component made of linear low density copolymer of ethylene and octene-1, which is linear low density polyethylene, containing substantially 1–10 weight percent octene-1 and having a density of 0.900–0.940 g/cm$^3$, a melt index value of 5–45 g/10 minutes as measured by the D-1238(E) of ASTM, and a heat of fusion of not less than 25 cal/g, and a core component made of polyethylene terephthalate, said bicomponent filaments being heat bonded together so that the number of defects is not more than 0.01/kg of the nonwoven fabric, the weight is 10–200 g/m$^2$ and the percentage bond area is 7–40%.

The number of defects, which is a value obtained by measurement of the transmittance of visible light, indicates unevenness of thickness of the nonwoven fabric (details of which will be later given). Further, percentage bond area refers to the ratio of the bond area to the total area of the nonwoven fabric.

Said LLDPE may contain not more than 15 weight percent other α-olefin with respect to octene-1. In addition, said LLDPE may contain such additives as a lubricating agent, pigment, dyestuff, stabilizer and flame retardant.

Filaments in the present invention are suitable for spunbonded nonwoven fabrics; since it is difficult to obtain a nonwoven fabric of good hand when single filament fineness is large, the invention is not directed to filaments whose single filament fineness exceeds 5 deniers.

Filaments and nonwoven fabrics having special hand can be obtained by making the cross section of filaments hollow or flat. That is, hollow filaments and nonwoven fabrics formed of hollow filaments exhibit bulkiness and warmth retention, while flat filaments and nonwoven fabrics formed of flat filaments increase soft touch.

In the melt spinning of hollow filaments using LLDPE, the effect of melt elasticity of polymer participating in the Barus effect is decreased because of the relationship with melt spinning temperature and influences of cooling rate of melt spun filaments. Thus, when continuous filaments are drawn by air gun spinnability is elevated and the number of defects in nonwoven fabrics decreases.

In the case of hollow filaments, the number of hollow is not limited to 1; they may be a number of hollows. As for percentage hollowness, it is preferably 3–50%; if it exceeds 50%, this degrades spinnability, resulting in fibrilization taking place in the filaments. On the contrary, if it is less than 3%, it is impossible to attain a reduction in the weight of filaments intended by the present invention.

In the case of flat filaments, their degree of flatness is preferably 1.5–4.0; if it exceeds 4.0, this degrades spinnability, resulting in a decrease in the strength of filaments obtained. On the contrary, if it is less than 1.5, it becomes difficult to develope a characteristic soft touch.

In the present invention, degree of hollowness is found by microscopic examination of the cross section of the filament to determine the diameter D of the outer shell and the diameter d of the hollow portion and calculating it according to the formula $d^2/D^2 \times 100$ (%). If there are n hollow portions, it is calculated according to the formula $n \times (d^2/D^2) \times 100$ (%). In the case where filaments are of non-circular cross section, it is found by using the image processing system, LUZEX-IID manufactured by Nireco to determine the cross sectional area A of filaments and the cross sectional area a of hollow portions, and then using the formula $(a/A) \times 100$ (%).

Degree of flatness is found by microscopically examining the cross section of filaments to determine the major length (L) and minor length (l) of oval portions, and using the formula L/l.

Polyethylene terephthalate used in bicomponent filaments has an intrinsic viscosity of preferably 0.50–1.20 measured at 20° C. in a mixture of solvents (phenol: tetrachloroethane = 1:1). If its intrinsic viscosity is less than 0.50, a filament of high tenacity can hardly be obtained and hence the resulting nonwoven fabric is not satisfactory, while if intrinsic viscosity exceeds 1.20, this results in poor spinnability. Further, a lubricating agent, pigment and stabilizer may be added to said polyethylene terephthalate.

It is preferable that the ratio of LLDPE, or the sheath component, to polyethylene terephthalate, or the core component of bicomponent filaments, be such that the amount of polyethylene terephthalate is 80–20 weight percent for 20–80 weight percent LLDPE. In the case where the amount of LLDPE is less than 20 weight percent, the tenacity of filaments is high, but the adhesive power decreases, so that a nonwoven fabric which is desirable from the stand point of hand cannot be obtained. On the contrary, a nonwoven fabric obtained when amount of LLDPE exceeds 80 weight percent, has high adhesive power for filaments and satisfactory hand, but its tenacity is low, a fact which is undesirable.

If the amount of octene-1 exceeds 10 weight percent in the present invention, fineness of filament is limited, and on the contrary if it is less than 1 weight percent, the resulting filaments are rigid, having poor hand. In the present invention, if the density of LLDPE exceeds 0.940, a reduction in the weight of filaments cannot be attained. Further, if the density is less than 0.900, it is difficult to obtain filaments of high tenacity.

The reason for limiting the MI value to LLDPE of 5–45 g/10 minutes as measured by D-1238(E) of ASTM is that in the case of LLDPE which exceeds this range, it becomes difficult to suitably select spinning condition or impossible to increase the strength of the resulting filaments. In other words, in the case of LLDPE whose MI value is less than 5 g/10 minutes, high speed spinning cannot be easily attained unless spinning temperature is increased; particularly, the spinneret surface is easily soiled during spinning, a fact which is undesirable from the standpoint of operation. On the contrary, in the case of LLDPE whose MI value exceeds 45 g/10 minutes, high speed spinning can be attained while lowering the spinning temperature, but the tenacity of filaments cannot be increased, a fact which is not desirable.

LLDPE whose heat of fusion is less than 25 cal/g has poor spinnability, for some reason which has not been adequately explained. In the spunbond method in which nonwoven fabrics are directly produced after continuous filaments have been drawn by air guns, LLDPE whose heat of fusion is less than 25 cal/g makes it necessary to increase the air pressure for the air guns if fine denier filaments are to be obtained. In this case, LLDPE whose heat of fusion is not less than 25 cal/g is advantageous in that it can be drawn with reduced air pressure and that finer-denier filaments can be obtained.

The heat of fusion in the present invention was found in the following manner.

DSC-2C manufactured by Perkin Elmer was used, a sample of about 5 mg was taken, and the scanning rate was 20.0° C./minute. The heat of fusion was determined according to the Manual with respect to DSC curve obtained by elevating the temperature to above the room temperature.

Filaments in the present invention can be obtained by a known melt spinning device. In the case of filaments using LLDPE alone, the spinning temperature is 220°–280° C., preferably 230°–270° C. In the case of bicomponent filaments using LLDPE and polyethylene terephthalate, the spinning temperature is 220°–270° C., preferably 230°–270° C., for LLDPE and 275°–295° C., preferably 280°–290° C., for polyethylene terephthalate.

If temperatures outside said ranges are used, spinning conditions are degraded, making it difficult to obtain a satisfactory nonwoven fabric. In other words, if the spinning temperatures are lower than in said ranges, it is difficult to increase the spinning speed and it is hard to obtain fine-denier filaments; further, it becomes necessary to increase air pressure for air guns, and the resulting nonwoven fabric is high in the number of defects owing to frequent filament breakage. On the contrary, if spinning temperatures are higher than in said ranges, the spinneret surface tends to be soiled; a long-term operation would result in a nonwoven fabric which is high in the member of defects owing to frequent filament breakage caused by the soiling of the spinneret surface. To prevent this, it would be necessary to clean the spinneret surface periodically and at frequent intervals, which means a high loss of products.

This tendency is pronounced in the case of bicomponent filaments using LLDPE and polyethylene terephthalate. That is, in the present invention, the middle value of melt spinning temperature is 250° C. for LLDPE and 285° C. for polyethylene terephthalate, the difference between the melt spinning temperatures for the two being very small; therefore, the cooling of bicomponent filaments subsequent to the melt extrusion can be smoothly effected, there being little tendency for strains due to uneven cooling of filaments to remain therein. For this reason, the resulting bicomponent filaments are uniform and spinnability is improved. Bicomponent filaments with less filament breakage can be obtained only if LLDPE with good spinnability at high temperatures is selected and the spinning temperatures for the two are made close to each other.

In the case of a spunbonded nonwoven fabric of 100% LLDPE or of bicomponent filaments using LLDPE and polyethylene terephthalate, any occurrence of filament breakage during spinning inevitably leads to a nonwoven fabric having a variation in weight or having a large hole. In the case of lightweight nonwoven fabric such as one having a weight of 10–30 g/m$^2$, the presence of a defect of large hole leads to poor operability since it breaks when pulled out from a roll form during processing. Even if it does not break, a wrinkle or puckering forms during processing, thus detracting from external appearance.

On the other hand, in the case where a heavyweight nonwoven fabric having a weight of not less than 50 g/m$^2$ is used as a base fabric for carpets, a hole formed in the nonwoven fabric owing to filament breakage would make it impossible to drive piles. Further, if the nonwoven fabric becomes too thick owing to excessive overlapping of webs caused by wrinkles or ravels which form during processing, piling does not proceed smoothly and sometimes needless break, thus degrading operability and external appearance.

For these reasons, in any weight range in the present invention, defects due to filament breakage lead to defects in the product. Thus, defects caused by filament breakage must be cut off when the product is delivered. As they are cut off at the stage of inspection, a short-sized fabric results.

In the present invention, the reason why the weight of a nonwoven fabric formed of LLDPE alone is restricted to 10–100 g/m$^2$ is that if the weight of the fabric is less than 10 g/m$^2$, the strength of the nonwoven fabric is too low to be practical, while if the weight of the nonwoven fabric exceeds 100 g/m$^2$, the resulting hand is not good.

The reason why the total hand value is restricted to 4–300 g is that a nonwoven fabric having a total hand value of less than 4 g is insufficient in strength, while a nonwoven fabric having a total hand value of more than 300 g is not desirable from the standpoint of hand. Further, the bond area over which the web is heat treated to heat-bond filaments has to do with the hand and strength of the nonwoven fabric. If the bond area is too small, the resulting nonwoven fabric is soft but is insufficient in strength and, on the contrary, if the bond area is too large, the resulting nonwoven fabric is not desirable since it is stiff though the strength is high. When it is desired to obtain a nonwoven fabric characterized by the softness of LLDPE alone, it is preferable that the percentage bond area be 7–20%. In the case of a nonwoven fabric formed of bicomponent filaments according to the invention, it is preferable that the percentage bond area be 7–40%.

The reason why the weight of a nonwoven fabric formed of bicomponent filaments according to the invention is restricted to 10–200 g/m$^2$ is that if the weight of the nonwoven fabric is less than 10 g/m$^2$, the strength of the nonwoven fabric is insufficient, while if the weight of the nonwoven fabric exceeds 200 g/m$^2$, heat bonding by heat treatment is difficult to effect and a nonwoven fabric having good hand can hardly be obtained.

Next, in order to increase the strength of the resulting nonwoven web while maintaining the soft hand of LLDPE and to suppress the napping of the nonwoven fabric surface filaments, the entangled filaments are heat-bonded by embossing hot rollers or the like. This heat-bonding temperature influences the hand and strength of the nonwoven fabric. In the present invention, heat bonding is effected at temperatures which are 15°–30° C. lower than the melting point of LLDPE, whereby a nonwoven fabric having both hand and strength can be obtained. That is, if the surface temperature of embossing hot rolls or the like is higher than the temperature of (the melting point of LLDPE—15° C.), although the strength of the nonwoven fabric is increased, it feels rigid, a fact which is not desirable. On the other hand, if the surface temperature of embossing hot rolls or the like is lower than the temperature of (the melting point of LLDPE—30° C.), although the hand of the nonwoven fabric is good, its strength is low since heat bonding between filaments is insufficient.

Nonwoven fabrics formed of continuous filaments according to the invention are high in strength and superior in softness and hand or touch. Thus, lightweight nonwoven fabrics are suitable particularly for use as linings for disposable diapers. Heavyweight nonwoven fabrics are applicable in a wide range including bags, carpet base fabrics and filters.

DESCRIPTION OF EXAMPLES

The invention will now be described in more detail by giving examples thereof.

Physical values noted in Examples were measured as follows.

(1) Tensile strength of nonwoven fabrics:

According to the strip method described in JIS L-1096, maximum tensile strength was measured from a 30 mm-wide 100 mm-long test piece.

(2) Total hand of nonwoven fabrics:

This is indicative of softness. According to the handle-o-meter method described in JIS L-1096, it was measured with a slot width of 10 mm.

(3) The number of defects:

A plurality of cameras (trade name; Video Measure, camera section type; 3X2CA-ZLFV, lens section type; 23Y0111C, manufactured by Omron Tateishi Electronics Co.) having an image sensor of the CCD (charge coupled device) type housed therein were installed widthwise of a nonwoven fabric to make it possible to continuously measure the intensity of light transmitted through the nonwoven fabric in the manufacturing process. More particularly, a fixed amount of light was directed to one side of the nonwoven fabric, while said cameras were installed at the opposite side to continuously measure the intensity of transmitted light throughout the width of the nonwoven fabric. Defects were measured by adjusting to a fixed value (1.5 V) the voltage value (transmitted intensity) of a photosensor dependent on the amount of light transmitted through the nonwoven fabric; when the voltage value associated with the traveling nonwoven fabric indicates a value which exceeds ±30% of the adjusted value, this is counted as a defect. In this manner, the number of defects per unit weight of the nonwoven fabric was automatically measured.

EXAMPLE 1

LLDPE containing 5 weight percent octene-1 and having a density of 0.937 g/cm$^3$, an MI value of 25 g/10 minutes as measured by the method of D-1238(E) of ASTM, a heat of fusion of 40 cal/g as measured by DCS, and a melting point of 125° C. was melt-extruded in a spinning temperature range of 230°-270° C. at a through put of 1.5 g/minute/hole through a spinneret having 64 holes of circular cross-section 0.20 mm in diameter, with air guns located 200 cm below the spinneret to form continuous multifilaments which were deposited on a moving collection belt to form a web weighing 10 g/m$^2$, said web being then heat-treated by a group of rolls including metal embossing hot rolls and metal hot rolls with a line pressure of 30 kg/cm, a percentage bond area of 12%, and a heat treating temperature of 105° C., thereby providing a spunbonded nonwoven fabric. The result is shown in Table 1.

COMPARATIVE EXAMPLE 1

As Comparative Example 1, a nonwoven fabric was formed under the same conditions as in Example 1 except that the spinning temperature was 200° C. It was found that Comparative Example 1 had more defects than Example 1. The result is shown in Table 1.

TABLE 1

| | | Example 1 | | | Comparative Example 1 |
|---|---|---|---|---|---|
| Spinning temperature (°C.) | | 230 | 250 | 270 | 200 |
| Air pressure in air guns, (kg/cm$^2$) | | 4.0 | 3.5 | 3.3 | 7.5 |
| Spinning speed (m/min) | | 7000 | 7000 | 7000 | 7000 |
| Single filament fineness (dpf) | | 1.9 | 1.9 | 1.9 | 1.9 |
| Characteristic of nonwoven fabric | Number of defects per kg | 0.005 | 0.005 | 0.008 | 0.050 |
| | Weight (g/m$^2$) | 10 | 10 | 10 | 10 |
| | Tensile strength (kg/3 cm) | 0.85 | 0.84 | 0.80 | 0.85 |
| | Total hand (g) | 6 | 6 | 6 | 6 |

COMPARATIVE EXAMPLES 2

LLDPE containing 5 weight percent octene-1 and having a density of 0.937 g/cm$^3$, an MI value of 25 g/10 minutes as measured by the method of D-1238(E) of ASTM, a heat of fusion of 20 cal/g as measured by DSC, and a melting point of 125° C. was used to form multifilaments which were formed into a spunbonded nonwoven fabric by the same method as in Example 1. The spinning speed could hardly be increased, and it could not be increased unless the air pressure in the air gun was increased. The number of defects was large. The result is shown in Table 2.

TABLE 2

| | | Comparative Example 2 | | | |
|---|---|---|---|---|---|
| Spinning temperature (°C.) | | 200 | 230 | 250 | 270 |
| Air pressure in air guns, (kg/cm$^2$) | | 5.5 | 5.0 | 7.0 | 6.5 |
| Spinning speed (m/min) | | 3500 | 4000 | 7000 | 6500 |
| Single filament fineness (dpf) | | 3.9 | 3.4 | 1.9 | 2.1 |
| Characteristic of nonwoven fabric | Number of defects per kg | 0.10 | 0.05 | 0.05 | 0.05 |
| | Weight (g/m$^2$) | 10 | 10 | 10 | 10 |
| | Tensile strength (kg/3 cm) | 0.75 | 0.77 | 0.75 | 0.70 |
| | Total hand (g) | 15 | 10 | 6 | 6 |

EXAMPLE 2

LLDPE containing 5 weight percent octene-1 and having a density of 0.937 g/cm$^3$, an MI value of 25 g/10 minutes as measured by the method of D-1238(E) of ASTM, and a heat of fusion of 40 cal/g as measured by DSC, was spun into hollow filaments at a spinning temperature of 230° C., a through put of 1.5 g/minute/hole through a spinneret having 64 ( )-shaped orifice and a spinning speed of 7000 m/min to form on a moving collection belt a web which was then formed into a spunbonded nonwoven fabric by exactly the same method as in Example 1. The result is shown in Table 3.

COMPARATIVE EXAMPLE 3

A nonwoven fabric was formed under the same conditions as in Example 1 except that the spinning temperature was 210° C. It was found that the spinning speed could not increased and that the number of defects was large. The result is shown in Table 3.

TABLE 3

| | | Example 2 | Comparative Example 3 |
|---|---|---|---|
| Spinning temperature (°C.) | | 230 | 210 |
| Air pressure in air guns, ($kg/cm^2$) | | 4.0 | 5.5 |
| Spinning speed (m/min) | | 7000 | 6000 |
| Percentage hollowness (%) | | 25 | 25 |
| Single filament fineness (dpf) | | 1.9 | 2.3 |
| Characteristic of nonwoven fabric | Number of defects per kg | 0.003 | 0.05 |
| | Weight ($g/m^2$) | 10 | 10 |
| | Tensile strength (kg/3 cm) | 0.98 | 1.00 |
| | Total hand (g) | 6 | 6 |

EXAMPLE 3

LLDPE containing 5 weight percent octene-1 and having a density of 0.937 $g/cm^3$, an MI value of 25 g/10 minutes, and a heat of fusion of 40 cal/g was melt-extruded at a spinning temperature of 230° C. and a through put of 1.5 g/minute/hole through a plurality of 0.6 mm (slit length)×0.1 mm (slit width)×64-hole spinnerets using air guns to form flat filaments at a spinning speed of 7000 m/min, said flat filaments being deposited on a moving collection belt to form a web which was then processed into a spunbonded nonwoven fabric by the same method as in Example 1. The result is shown in Table 4.

COMPARATIVE EXAMPLE 4

A nonwoven fabric was formed under the same conditions as in Example 3 except that the spinning temperature was 210° C. It was found that the number of defects was large. The result is shown in Table 4.

TABLE 4

| | | Example 3 | Comparative Example 4 |
|---|---|---|---|
| Spinning temperature (°C.) | | 230 | 210 |
| Air pressure in air guns, ($kg/cm^2$) | | 4.0 | 6.0 |
| Spinning speed (m/min) | | 7000 | 7000 |
| Degree of flatness | | 2.5 | 2.5 |
| Single filament fineness (dpf) | | 1.9 | 1.9 |
| Characteristic of nonwoven fabric | Number of defects per kg | 0.005 | 0.04 |
| | Weight ($g/m^2$) | 10 | 10 |
| | Tensile strength (kg/3 cm) | 0.80 | 0.80 |
| | Total hand (g) | 4 | 4 |

EXAMPLE 4

LLDPE containing 5 weight percent octene-1 and having a density of 0.937 $g/cm^3$, an MI value of 25 g/10 minutes as measured by the method of D-1238(E) of ASTM, a heat of fusion of 40 cal/g as measured by DSC, and a melting point of 125° C. was used as a sheath component, while polyethylene terephthalate having an intrinisic viscosity of 0.70 (measured in a solvent which is a 1:1 mixture of phenol and tetrachloroethane at 20° C.) was used as a core component. Using a composite spinneret with 200 holes and at a melting temperature of 250° C. for LLDPE and at a melting temperature of 290° C. for polyethylene terephthalate, at a through put of 1.70 g/min/hole, and at a sheath-core ratio of LLDPE to polyethylene terephthalate of 50:50 by weight, the LLDPE and polyethylene terephthalate were melt-extruded, with air guns located 200 cm below the spinnerets to draw a multifilament.

COMPARATIVE EXAMPLE 5

LLDPE containing 5 weight percent octene-1 and having a density of 0.937 $g/cm^3$, an MI value of 25 g/10 minutes as measured by the method of D-1238(E) of ASTM, a heat of fusion of 20 cal/g as measured by DSC, and a melting point of 125° C. was used to form multifilaments by the same method as in Example 4. The result obtained is shown in Table 5.

Example 4 made it possible to increase the spinning speed more then Comparative Example 5 and readily provided finer filaments and was superior in filament quality. Further, is was possible to increase the spinning speed by lowering the air pressure for the air guns.

TABLE 5

| | | Example 4 | Comparative Example 5 |
|---|---|---|---|
| Number of defects | time/600 min | 0 | 5 |
| Air pressure | $kg/cm^2$ | 3.0 | 4.5 |
| Spinning speed | m/min | 5,000 | 3,600 |
| Single filament fineness | dpf | 3.0 | 4.2 |
| Tenacity | g/d | 3.2 | 2.5 |
| Elongation | % | 55.0 | 65.0 |

EXAMPLE 5

The multifilaments obtained by using the air guns of Example 4 were deposited on a moving collection belt to form a web weighing 15 $g/m^2$, said web being then heat-treated by a group of rolls including metal embossing hot rolls and metal hot rolls at a line pressure of 30 kg/cm, a percentage bond area of 15% and a heat treatment temperature ranging from 95° C. to 110° C., whereby a spunbonded nonwoven fabric was obtained.

COMPARATIVE EXAMPLE 6

In Comparative Example 6, heat treatment temperatures of 90° C. and 115° C. were used.

The characteristics of the nonwoven fabrics are shown in Table 6. As is clear from Table 6, a nonwoven fabric of superior performance is obtained when the heat treatment temperature is 15°-30° C. lower than the melting point of the sheath component.

TABLE 6

| | Melting point of sheath component of bicomponent filament °C. | Heat treatment temperature °C. | Characteristic of nonwoven fabric | | | |
|---|---|---|---|---|---|---|
| | | | Weight g/m² | Strength per 3 cm kg | Total hand g | General evaluation based on strength and total hand |
| Comparative Example 6 | 125 | 90 | 15 | 0.60 | 6 | Bad |
| Example 5 | 125 | 95 | 15 | 1.28 | 8 | Good |
| Example 5 | 125 | 100 | 15 | 1.79 | 8 | Good |
| Example 5 | 125 | 105 | 15 | 2.10 | 10 | Good |
| Example 5 | 125 | 110 | 15 | 2.50 | 12 | Good |
| Comparative Example 6 | 125 | 115 | 15 | 3.38 | 55 | Bad |

EXAMPLE 6

The LLDPE and polyethylene terephthalate of Example 4 were spun under the same conditions as in Example 4 except that the composite ratio of LLDPE to polyethylene terephthalate weas 60:40, whereby multifilaments having a single filament fineness of 3.0 d, a tenacity of 3.0 g/d, and an elongation of 60.0% was obtained. A spunbonded nonwoven fabric was obtained in the same manner as in Example 5. The characteristics of the nonwoven fabric obtained are shown in Table 7. As is clear from Table 7, a nonwoven fabric of superior performance is obtained when the heat treatment temperature is 15°-30° C. lower than the melting point of the sheath component.

COMPARATIVE EXAMPLE 7

In Comparative Example 7, heat treatment temperatures of 90° C. and 115° C. were used.

TABLE 7

| | Melting point of sheath component of bicomponent filament °C. | Heat treatment temperature °C. | Characteristic of nonwoven fabric | | | |
|---|---|---|---|---|---|---|
| | | | Weight g/m² | Strength per 3 cm kg | Total hand g | General evaluation based on strength and total hand |
| Comparative Example 7 | 125 | 90 | 15 | 0.52 | 5 | Bad |
| Example 6 | 125 | 95 | 15 | 1.13 | 5 | Good |
| Example 6 | 125 | 100 | 15 | 1.71 | 7 | Good |
| Example 6 | 125 | 105 | 15 | 2.02 | 8 | Good |
| Example 6 | 125 | 110 | 15 | 2.27 | 10 | Good |
| Comparative Example 7 | 125 | 115 | 15 | 2.84 | 43 | Bad |

What is claimed is:

1. A nonwoven fabric comprising filaments formed of linear low density copolymer of ethylene and octene-1, which is linear low density polyethylene, containing substantially 1-10 weight percent octene-1 and having a density of 0.900-0.940 g/cm³, a melt index value of 5-45 g/10 minutes as measured by the D-1238(E) of ASTM, and a heat of fusion of not less than 25 cal/g as measured by DSC, said filaments being heat bonded together so that said nonwoven fabric has a number of defects not more than 0.01/kg of the fabric, a weight of 10-100 g/m², a percentage bond area of 7-20% and a total hand value of 4-300 g.

2. A nonwoven fabric as set forth in claim 1, wherein the single filament fineness of the filaments forming the nonwoven fabric is not more than 5 deniers.

3. A nonwoven fabric as set forth in claim 1, wherein the single filament fieness of the filaments forming the nonwoven fabric is not more than 5 deniers and the cross section of said filaments is hollow, the percentage hollowness being 3-50%.

4. A nonwoven fabric as set forth in claim 1, wherein the single filament fineness of the filaments forming the nonwoven fabric is not more than 5 deniers and the cross section of said filaments is flat, the degree of flatness being 1.5-4.0.

5. A nonwoven fabric as set forth in claim 1 made by:

melt extruding said linear low density polyethylene at a spinning temperature of 220-250 degrees C.;

drawing the resulting filaments at a high speed by air guns to form filaments having a single filament fineness of not more than 5 deniers, depositing said filaments on a moving collection belt to form a web; and heat-treating said web at a temperature which is 15-30 degrees C. lower than the melting point of said filaments.

* * * * *